US007009592B2

(12) United States Patent
Shen et al.

(10) Patent No.: US 7,009,592 B2
(45) Date of Patent: Mar. 7, 2006

(54) METHOD FOR DRIVING TRANSFLECTIVE LIQUID CRYSTAL DISPLAY

(75) Inventors: Yuh-Ren Shen, Tainan (TW); Ching-Yih Chen, Miaoli (TW)

(73) Assignee: Industrial Technology Research Institute, Hsinchu (TW)

( * ) Notice: Subject to any disclaimer, the term of this patent is extended or adjusted under 35 U.S.C. 154(b) by 393 days.

(21) Appl. No.: 10/643,186

(22) Filed: Aug. 18, 2003

(65) Prior Publication Data

US 2004/0201560 A1 Oct. 14, 2004

(30) Foreign Application Priority Data

Apr. 9, 2003 (TW) ..... 92108095 A

(51) Int. Cl.
*G09G 3/36* (2006.01)

(52) U.S. Cl. ..... 345/87; 345/204; 349/114

(58) Field of Classification Search ..... 345/87, 345/204; 349/114
See application file for complete search history.

(56) References Cited

U.S. PATENT DOCUMENTS

| | | | |
|---|---|---|---|
| 3,748,018 A | 7/1973 | Borden, Jr. | |
| 4,017,155 A | 4/1977 | Yagi et al. | |
| 4,093,356 A | 6/1978 | Bigelow | |
| 4,315,258 A | 2/1982 | McKnight et al. | |
| 4,398,805 A | 8/1983 | Cole | |
| 4,541,692 A | 9/1985 | Collins et al. | |
| 4,637,687 A | 1/1987 | Haim et al. | |
| 4,693,560 A | 9/1987 | Wiley | |
| 4,826,296 A | 5/1989 | Yoshimura | |
| 5,146,355 A | 9/1992 | Prince et al. | |
| 5,686,979 A | 11/1997 | Weber et al. | |
| 5,841,494 A | 11/1998 | Hall | |
| 5,986,730 A | 11/1999 | Hansen et al. | |
| 6,008,871 A | 12/1999 | Okumura | |
| 6,124,971 A | 9/2000 | Ouderkirk et al. | |
| 6,195,140 B1 | 2/2001 | Kubo et al. | |
| 6,262,842 B1 | 7/2001 | Ouderkirk et al. | |
| 6,285,422 B1 | 9/2001 | Maeda et al. | |
| 6,636,286 B1 * | 10/2003 | Baek | 349/114 |
| 2003/0112213 A1 * | 6/2003 | Noguchi et al. | 345/96 |
| 2004/0239846 A1 * | 12/2004 | Wen et al. | 349/114 |

* cited by examiner

*Primary Examiner*—Sumati Lefkowitz
*Assistant Examiner*—Ke Xiao
(74) *Attorney, Agent, or Firm*—Quintero Law Office

(57) ABSTRACT

A method for driving a transflective LCD. In the present invention, the transflective LCD has a plurality of pixels arranged in a matrix, and each pixel includes a reflective cell and a transmission cell. The reflective cell and transmission cells are driven by different transistors. In the method of the present invention, all the first switching devices are turned on and the first driving voltages are then applied to the reflective cells in turn. After that, all the second switching devices are turned on and the second driving voltages are then applied to the transmission cells in turn. The first driving voltages are applied to the reflective cells in turn and the second driving voltages are applied to the transmission cells in turn in one frame period.

10 Claims, 16 Drawing Sheets

METHOD FOR DRIVING TRANSFLECTIVE LIQUID CRYSTAL DISPLAY

BACKGROUND OF THE INVENTION

1. Field of the Invention

The present invention relates to LCD driving methods, and more particularly, to a driving method for transflective liquid crystal display.

2. Description of the Related Art

A pixel of a conventional transflective LCD has a reflective cell and a transmission cell. Unavoidably, the reflective cell having nearly double the phase difference of the transmission cell. Reduction of cell gap of the reflective cell to approach that of the transmission cell has been adopted in the past to address this issue. FIG. 1A shows a perspective diagram of a pixel of a conventional transflective LCD. The pixel includes a reflective cell 10 and a transmission cell 20. The reflective cell 10 has a reflective film 12 and a cell gap d1. The transmission cell 20 has a cell gap d2.

An equivalent circuit is shown in FIG. 1B. The reflective cell 10 and transmission cell 20 are both coupled to a storage capacitor Cs and a TFT (thin-film-transistor) transistor T1. Thus, only driving voltage can be supplied. The anti-inversion approach adjusts the cell gap d1 and d2 to the same phase difference. The cell gap d1 and d2 must be optimized to fit the LCD's operating mode, an approach that is difficult to adjust.

SUMMARY OF THE INVENTION

Accordingly, an object of the present invention is to provide a method for driving a transflective LCD effectively to achieve optimal reflectivity and transmittance without adjusting the cell gaps.

According to the object of the invention, the method for driving the transflective LCD includes the following steps. A transflective LCD is provided, having a plurality of pixels arranged in a matrix, each composed of a reflective cell and a transmission cell. The reflective cell has a first storage capacitor and a first active device, and the transmission cell having a second storage capacitor and a second active device. In the driving method of the present invention, first switching devices are coupled between the reflective cells of the pixels and first driving voltages respectively. Second switching devices are coupled between the transmission cells of the pixels and second driving voltages respectively. All the first switching devices are turned on and the first driving voltages are applied to the reflective cells in turn, and then all the second switching devices are turned on and the second driving voltages are applied to the transmission cells in turn. The first driving voltages are applied to the reflective cells in turn and the second driving voltages are applied to the transmission cells in turn in one frame period.

The present invention also provides another method for driving the transflective LCD, including the following steps. First switching devices are coupled between the reflective cells of the pixels and first driving voltages respectively. Second switching devices are coupled between the transmission cells of the pixels and second driving voltages respectively. In the present invention, rows of the pixels are scanned in turn in one frame period. The first switching devices and the second devices are turned on at different times to apply the first driving voltage to the reflective cells and the second driving voltage to the transmission cells respectively, when each pixel row is scanned.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1A:
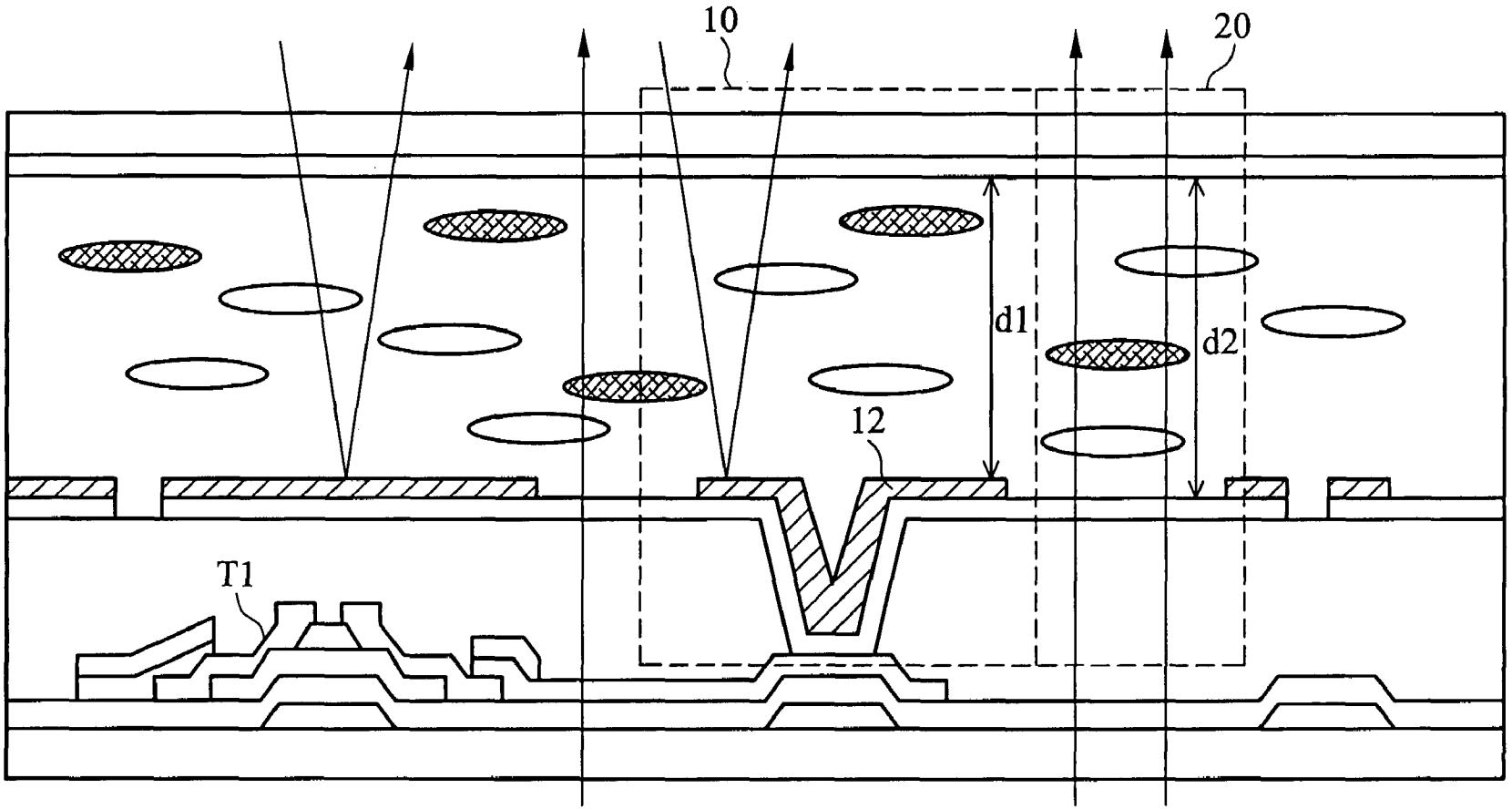
FIG. 1A ( PRIOR ART )
FIG. 1A is a cross section illustrating the pixel structure of a conventional LCD.
Figure 1B:
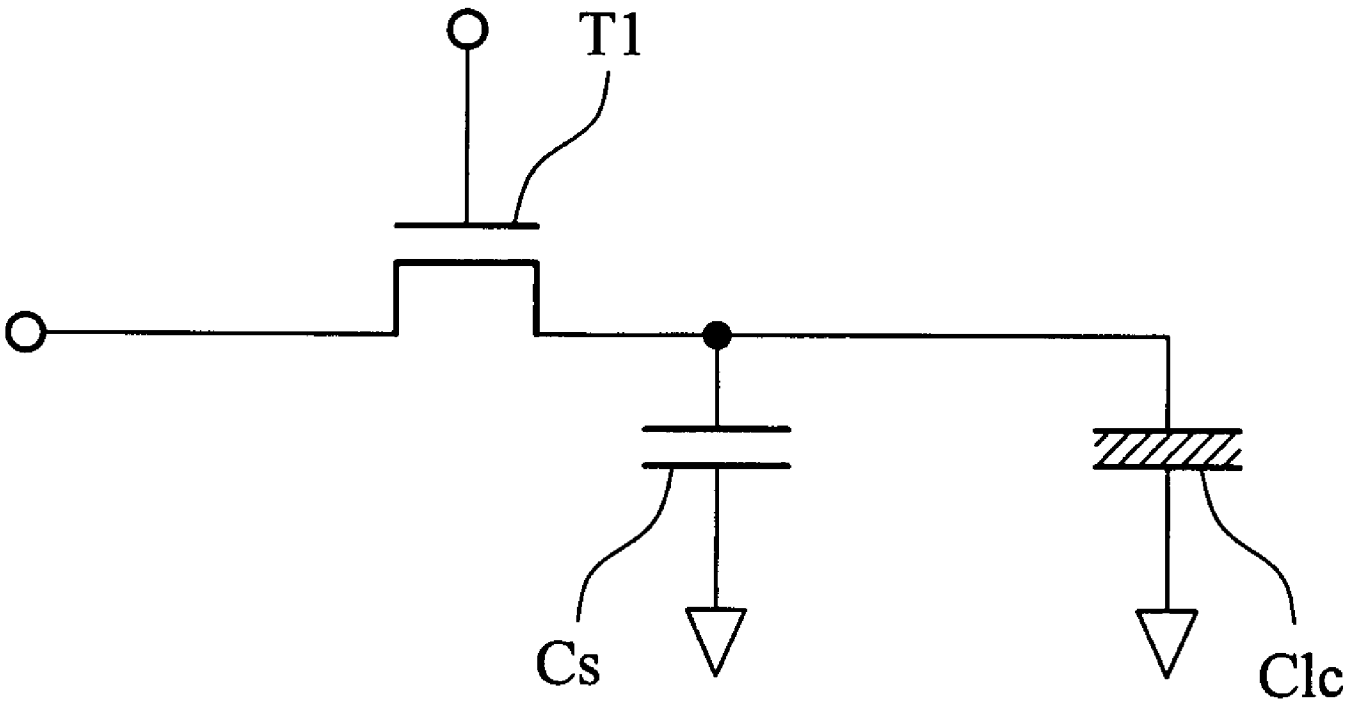
FIG. 1B ( PRIOR ART )
FIG. 1B is an equivalent circuit illustrating the pixel structure of a conventional LCD.
Figure 2A:
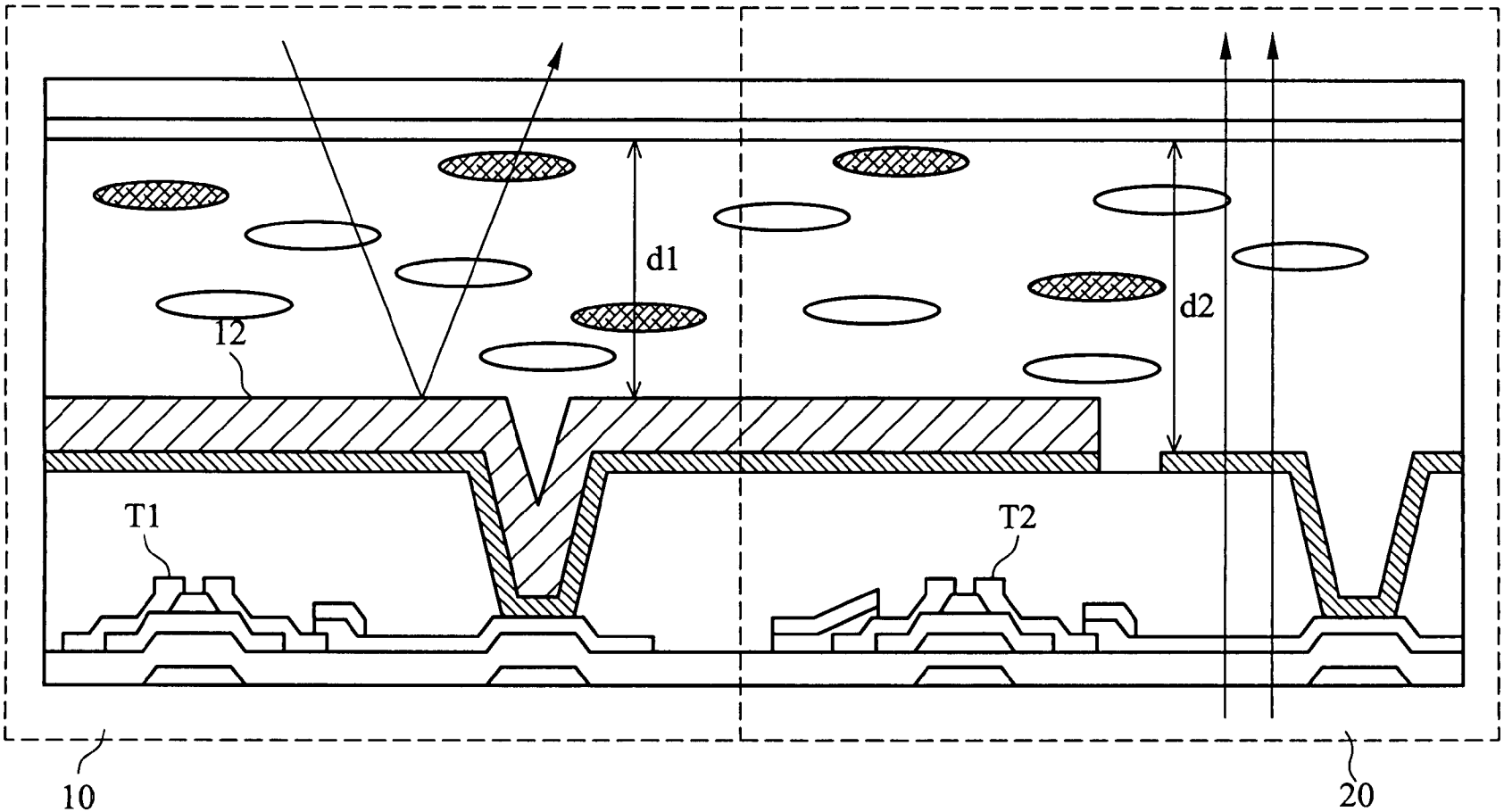
FIG. 2A is a cross section illustrating the pixel structure of the present invention.
Figure 2B:
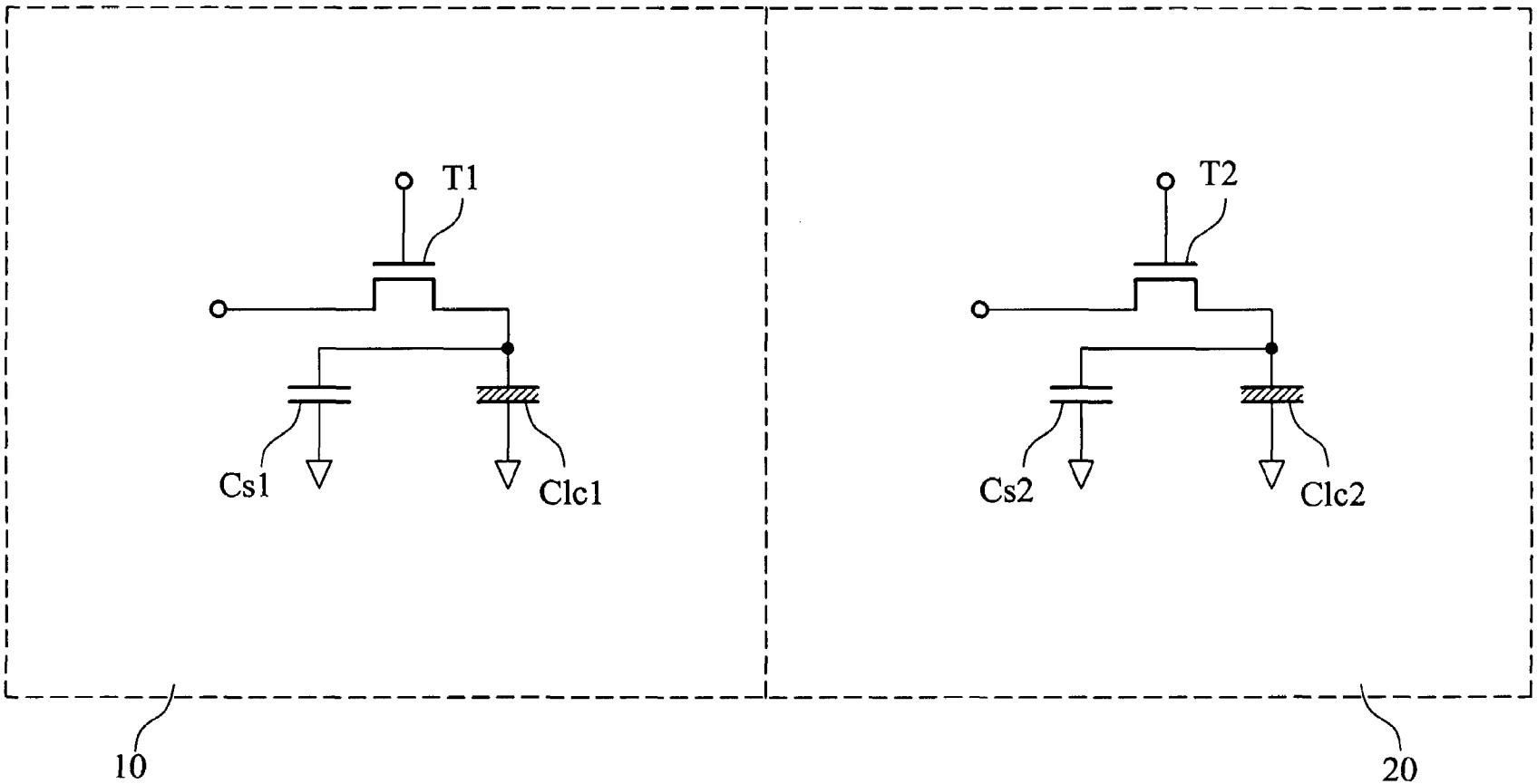
FIG. 2B is an equivalent circuit illustrating the pixel structure of the present invention.

FIG. 2*a* shows a perspective diagram of a pixel structure in a transflective LCD of the present invention. The pixel includes a reflective cell 10 and a transmission cell 20. The reflective cell 10 has a reflective film 12 and a cell gap d1. The transmission cell 20 has a cell gap d2. FIG. 2B shows an equivalent circuit of the pixel. In the reflective cell 10, an equivalent capacitor of the reflective cell 10 is represented by Clc1, a storage capacitor is Cs1, and a TFT transistor is T1. In the transmission cell 20, an equivalent capacitor of the transmission cell 10 is represented by Clc2, a storage capacitor is Cs2, and a TFT transistor is T2. The TFT transistors T1 and T2 can be disposed under the reflective film 12.

Figure 3A:
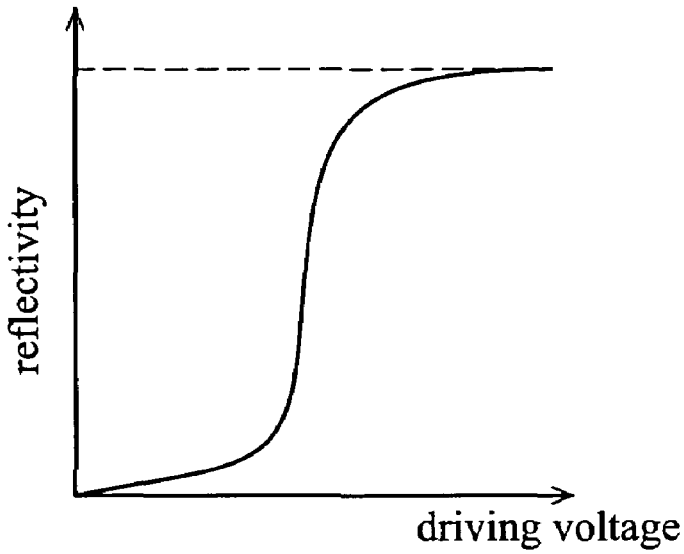
FIG. 3A shows a reflectivity gamma curve RV1 for quarter wave phase difference in the reflectivity cell.
Figure 3B:
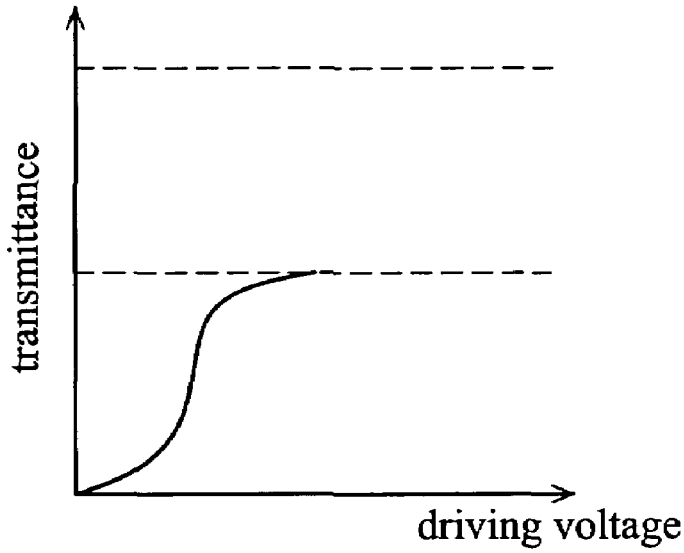
FIG. 3B shows a transmittance gamma curve TV1 for quarter wave phase difference in the transmission cell.

Operating in quarter wave phase difference of the transmission cell 20, a reflectivity gamma curve RV1 showing reflectivity versus driving voltage VR of the reflective cell 10 is shown in FIG. 3A. Because the phase difference through the reflective cell 10 is twice that of the transmission cell 20, the maximum reflectivity occurs in half wave. A transmittance gamma curve TV1 showing transmittance versus driving voltage VT of the transmission cell 10 is shown in FIG. 3B, and the maximum transmittance occurs in quarter wave.

Figure 3C:
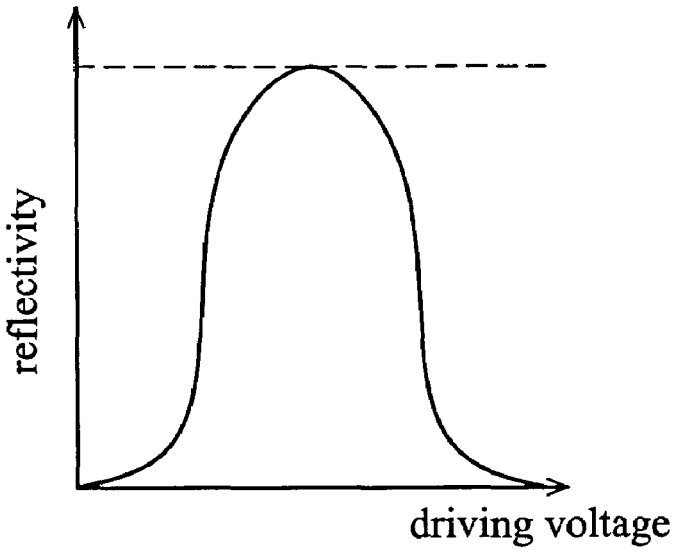
FIG. 3C shows a reflectivity gamma curve RV1 for half wave phase difference in the reflectivity cell.
Figure 3D:
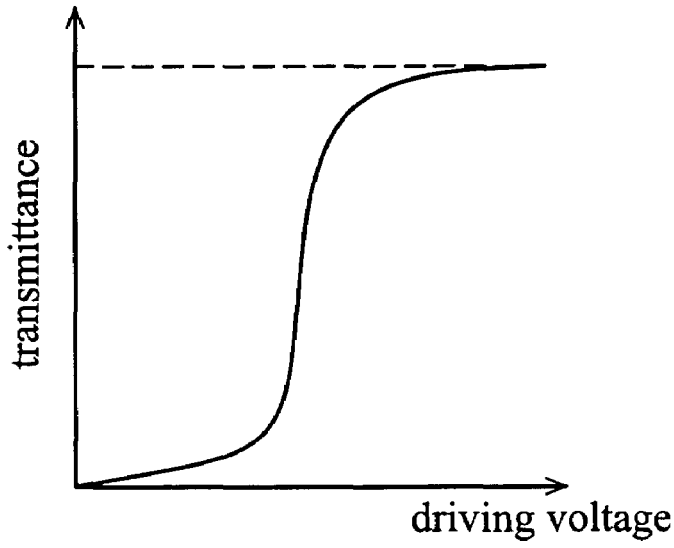
FIG. 3D shows a transmittance gamma curve TV1 for half wave phase difference in the transmission cell.

Operating in half wave phase difference of the transmission cell 20, a reflectivity gamma curve RV2 showing reflectivity versus driving voltage VR of the reflective cell 10 is shown in FIG. 3C. Because the phase difference through the reflective cell 10 is twice that of the transmission cell 20, the maximum reflectivity occurs in half wave. The reflectivity decreases with driving voltage VR when the phase difference exceeds half wave. A transmittance gamma curve TV2 showing transmittance versus driving voltage VT of the transmission cell 10 is shown in FIG. 3D, and the maximum transmittance occurs in half wave.

Because the pixel in the present invention has two TFT, T1 and T2, and two storage capacitors Cs1 and Cs2, to control driving voltage VR and VT respectively, the reflective cell 10 and transmission cell 20 achieve the same phase difference without adjusting the cell gap d1 and d2. The driving voltage VR for the reflective cell 10 can be driven by the quarter wave gamma curve RV1 or by half wave gamma curve RV2. The driving voltage VT for the transmission cell 20 can be driven by the quarter wave gamma curve TV1 or by half wave gamma curve TV2. The reflective cell 10 and the transmission cell 20 are corrected by reflectivity and transmittance gamma curve respectively to meet requirements.

Figure 4A:
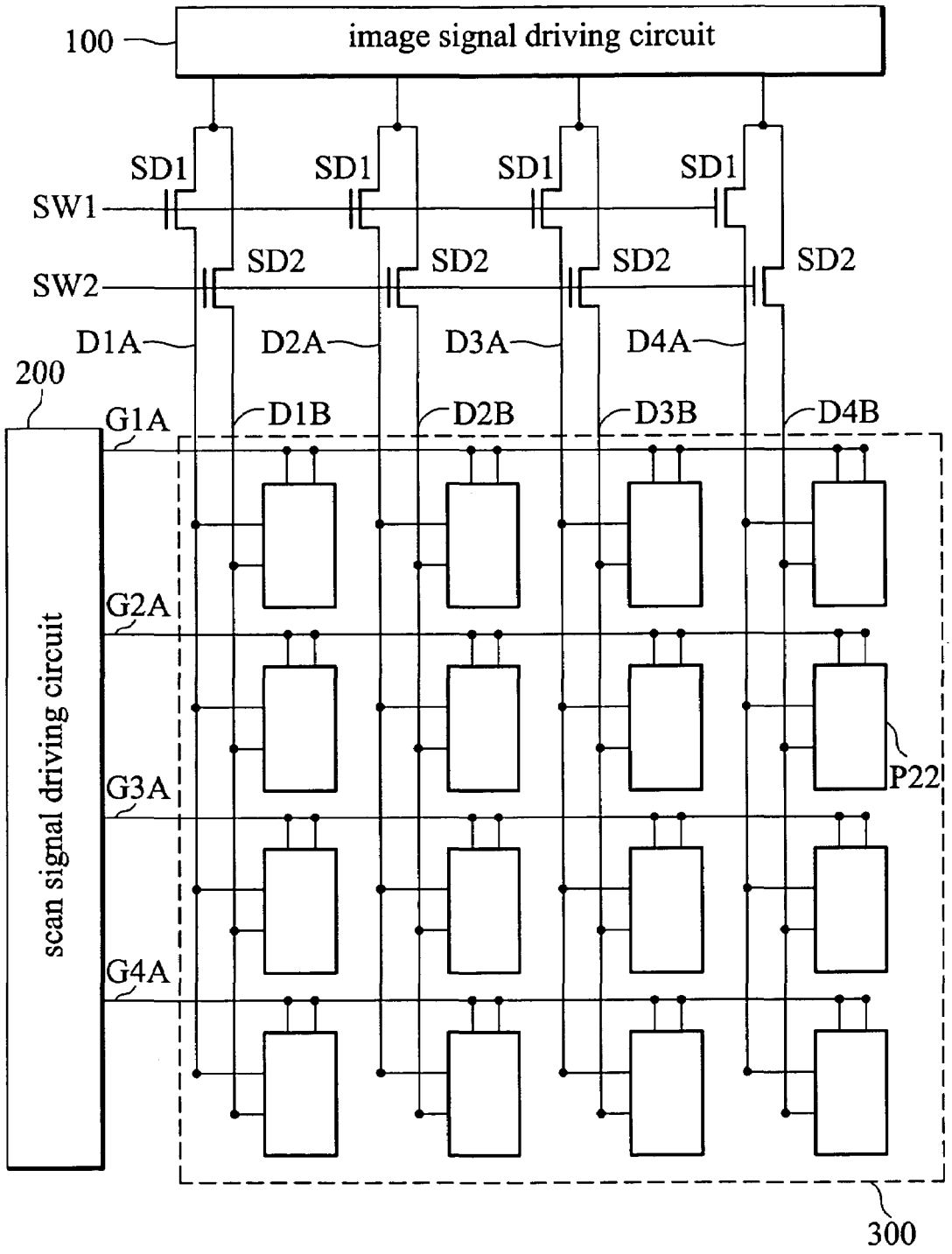
FIG. 4A shows a block diagram of an LCD in the present invention.
Figure 4B:
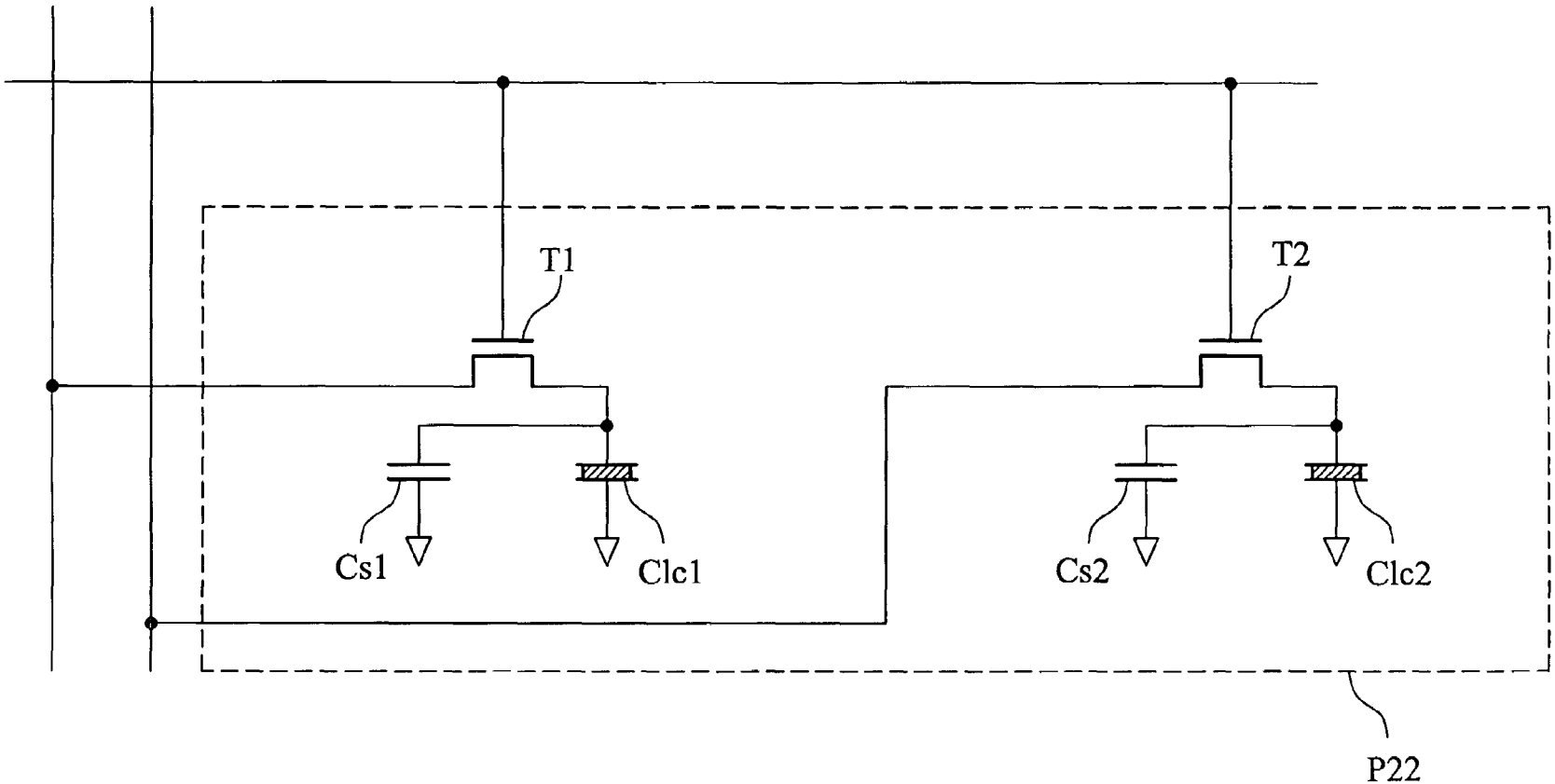
FIG. 4B shows a schematic diagram of a pixel P22 in FIG. 4A.

FIG. 4A shows a block diagram of an LCD in the present invention. The LCD includes a TFT transistor array 300, an image-signal driving circuit 100 and 120, and a scan-signal driving circuit 200. FIG. 4B shows a schematic diagram of a pixel P22 in FIG. 4A. Other pixels in FIG. 4A have the same schematic as shown in FIG. 4A. The pixel P22 has a reflective cell 10 and a transmission cell 20, and thus requires two sets of TFT transistors and storage capacitors.

The TFT transistor T1 is disposed at the intersection of the row G2A and column D2A. A gate of the TFT transistor T1 is coupled to row 2A, a drain of the TFT T1 is coupled to column D2A, and a source of the TFT transistor T1 is coupled to Clc1 and storage capacitor Cs1. The TFT transistor T2 is disposed at the intersection of row G2A and column D2B. A gate of the TFT transistor T2 is coupled to row 2A, a drain of the TFT T2 is coupled to column D2B, and a source of the TFT transistor T2 is coupled to Clc2 and storage capacitor Cs2. All pixels in the TFT transistor array 300 have the same wiring structure.

The scan signal driving circuit 200 generates scan signals fed to gates of TFT transistors T1 or T2 via rows G1A–G4A. The image signal driving circuit 100 generates image signals corresponding to scan signals fed to reflective cells 10 via column D1A–D4A, switching devices SD1 and TFT transistor array 300. Also, the image signal driving circuit 100 generates image signals corresponding to scan signals fed to transmissions cell 20 via column D1B–D4B, switching devices SD2 and TFT transistor array 300.

The First Embodiment

Figure 5A:
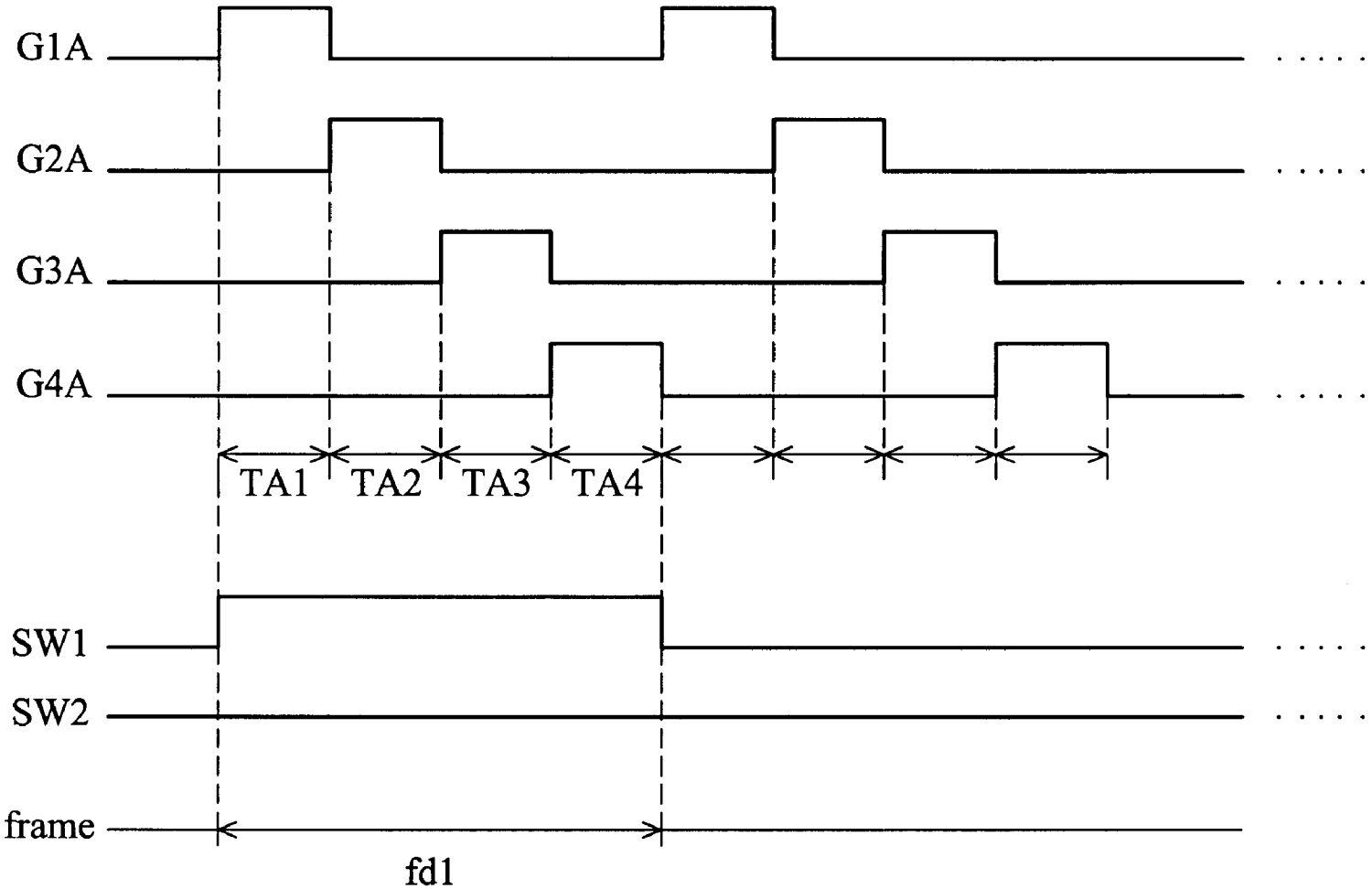
FIG. 5A shows a diagram of all waveforms in the first embodiment.

FIG. 5A shows a diagram of all waveforms in the first embodiment. In this embodiment, only reflective cells 10 are scanned in turn in one frame period fd1 as shown in FIG. 5A. In FIG. 5A, a frame period fd1 is divided into periods TA1, TA2, TA3 and TA4. The image signal driving circuit 100 feeds image signals (first driving voltages) to capacitors Clc1 and Cs1 in reflective cell 10 via columns D1A–D4A and switching device SD1 in periods TA1, TA2, TA3 and TA4, when rows G1A–G4A are active respectively. In frame period fd1, all switching devices SD1 are turned on and all switching devices SD2 are turned off.

The Second Embodiment

Figure 5B:
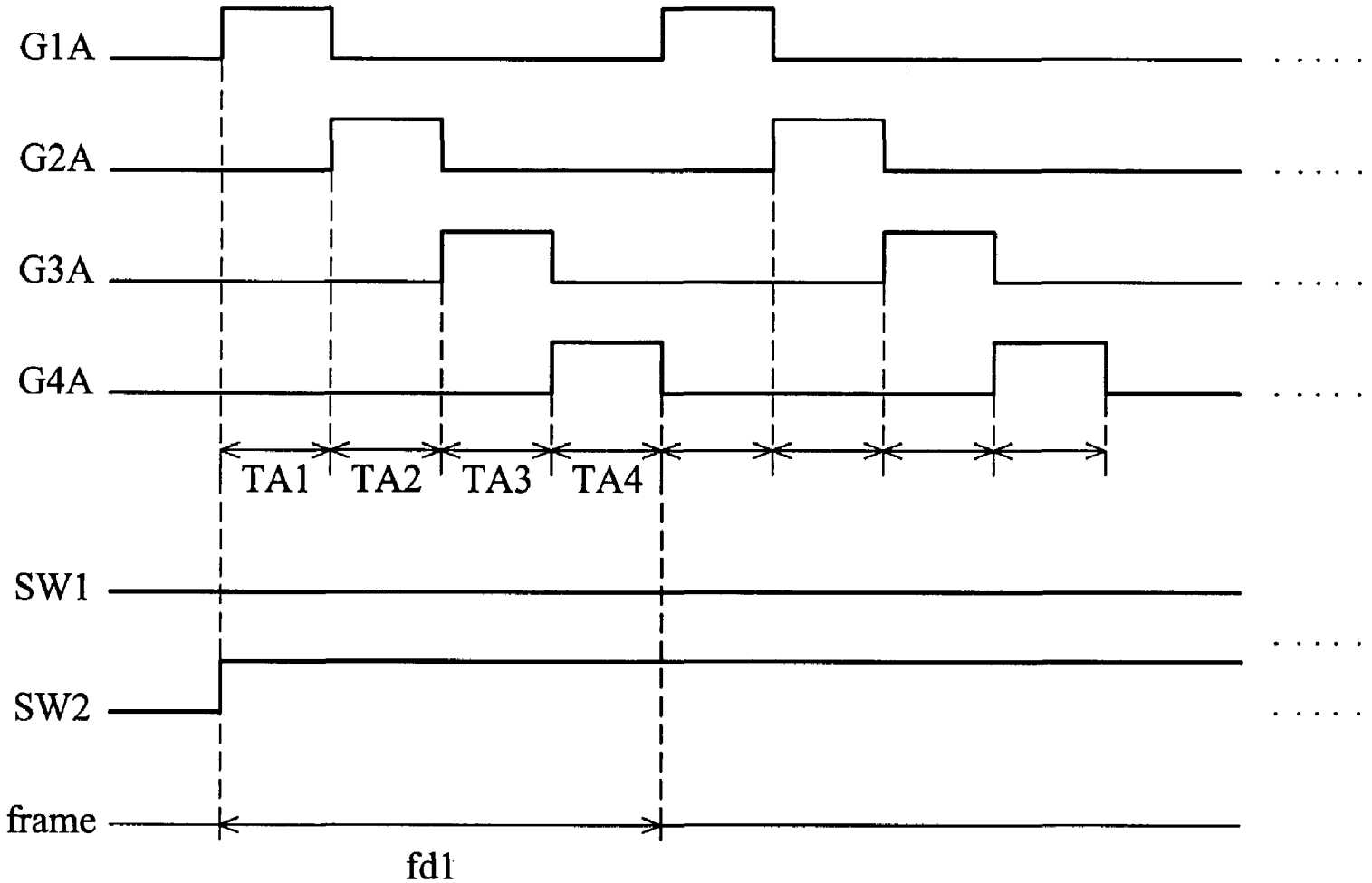
FIG. 5B shows a diagram of all waveforms in the second embodiment.

FIG. 5B shows a diagram of all waveforms in the second embodiment. In this embodiment, only transmission cells 20 are scanned in turn in one frame period fd1 as shown in FIG. 5B. In FIG. 5B, a frame period fd1 is divided into periods TA1, TA2, TA3 and TA4. The image signal driving circuit 100 feeds image signals (second driving voltages) to capacitors Clc2 and Cs2 in reflective cell 20 via columns D1B–D4B and switching device SD2 in periods TA1, TA2, TA3 and TA4, when rows G1A–G4A are active respectively. In frame period fd1, all switching devices SD2 are turned on and all switching devices SD1 are turned off.

In the first and second embodiments, only a reflective cell or transmission cell is turned on for display in one frame period, thereby saving power.

The Third Embodiment

Figure 6A:
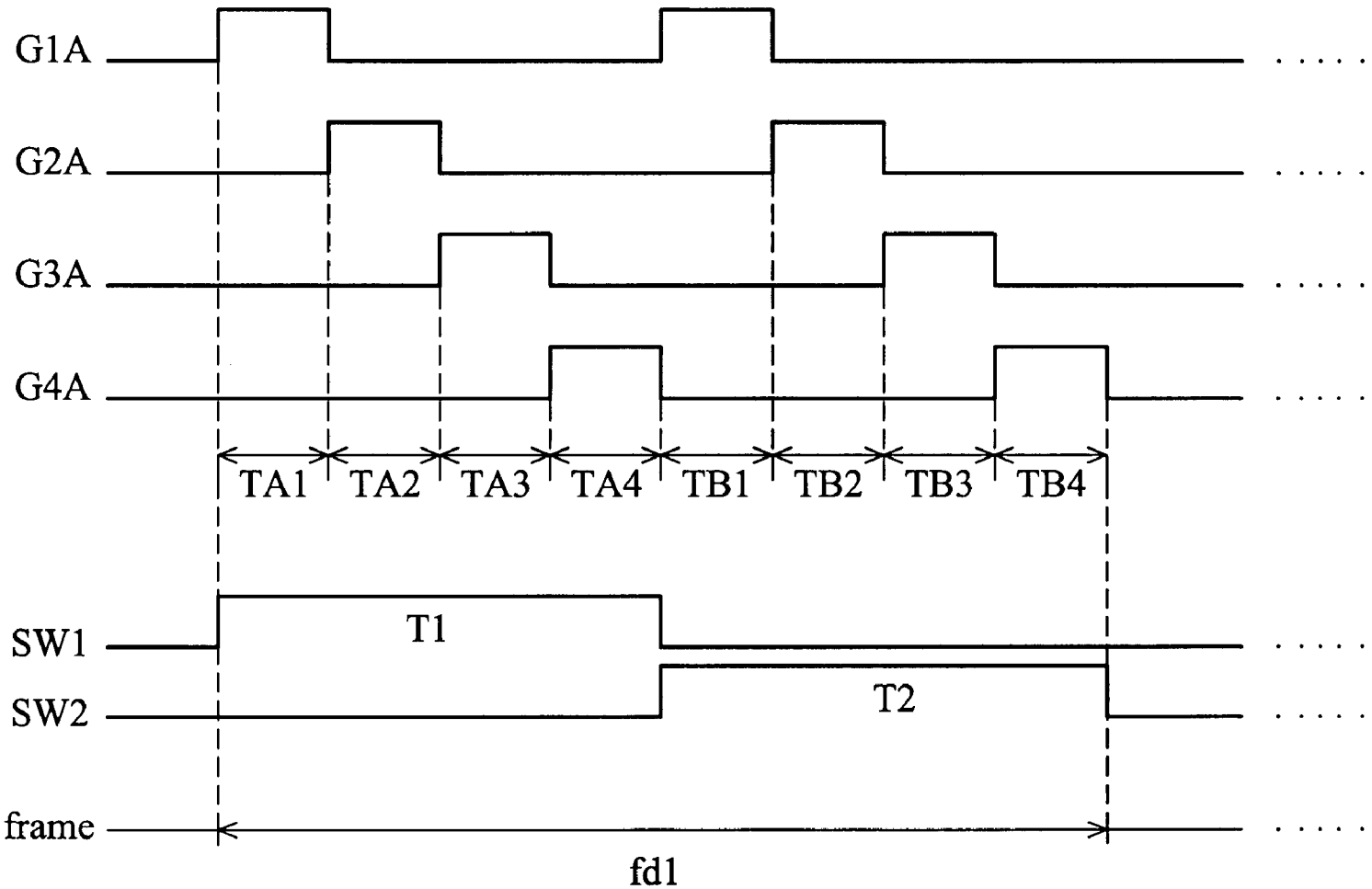
FIG. 6A shows a diagram of all waveforms in the third embodiment.

FIG. 6A shows a diagram of all waveforms in the third embodiment. In one frame period fd1, the reflective cells 10 are turned on in turn when the first switching devices SD1 are turned on, and the transmission cells 20 are then turned on in turn when the second switching devices SD2 are turned on, as shown in FIG. 6A. In FIG. 6A, period T1 is divided into periods TA1–TA4, and period T2 is divided into periods TB1–TB2, and frame period fd1 includes periods T1 and T2.

The image signal driving circuit 100 feeds image signals (first driving voltages) to capacitors Clc1 and Cs1 in reflective cells 10 via columns D1A–D4A and switching devices SD1 in periods TA1, TA2, TA3 and TA4, when rows G1A–G4A are active respectively. The image signal driving circuit 100 then feeds image signals (second driving voltages) to capacitors Clc2 and Cs2 in transmission cells 20 via columns D1B–D4B and switching devices SD2 in periods TB1, TB2, TB3 and TB4, when rows G1A–G4A are active respectively. In frame period fd1, all switching devices SD1 are turned on and all switching devices SD2 are turned off. In periods TA1–TA4 (T1), all switching devices SD1 are turned on and all switching devices SD2 are turned off. In periods TB1–TB4 (T2), all switching devices SD2 are turned on and all switching devices SD1 are turned off.

The Fourth Embodiment

Figure 6B:
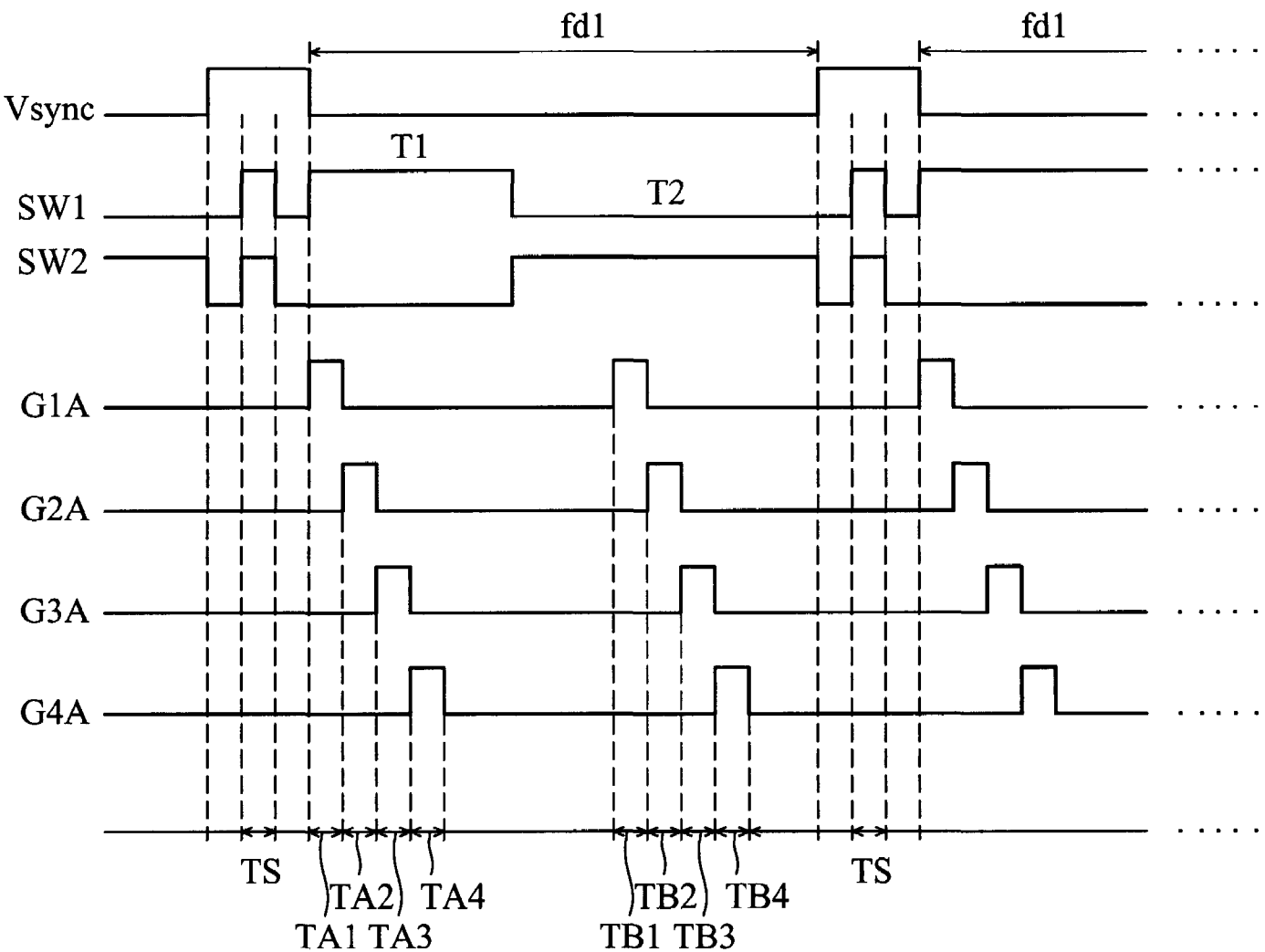
FIG. 6B shows a diagram of all waveforms in the fourth embodiment.

FIG. 6B shows a diagram of all waveforms in the third embodiment. As shown in FIG. 6A, in one frame period fd1, the reflective cells 10 are turned on in turn when the first switching devices SD1 are turned on, and the transmission cells 20 are then turned on in turn when the second switching devices SD2 are turned on. In this case, a charge sharing period TS occurs before each frame period fd1, wherein the period TS depends on an external signal Vsync. In each charge sharing period TS, all switching devices SD1 and SD2 are turned on without scanning rows G1A–G4A.

The image signal driving circuit 100 feeds image signals (first driving voltages) to capacitors Clc1 and Cs1 in reflective cell 10 via columns D1A–D4A and switching device SD1 in periods TA1, TA2, TA3 and TA4, when rows G1A–G4A are active respectively. The image signal driving circuit 100 then feeds image signals (second driving voltages) to capacitors Clc2 and Cs2 in transmission cell 20 via columns D1B–D4B and switching device SD2 in periods TB1, TB2, TB3 and TB4, when rows G1A–G4A are active respectively. In periods TA1–TA4 (T1), all switching devices SD1 are turned on and all switching devices SD2 are turned off. In periods TB1–TB4 (T2), all switching devices SD2 are turned on and all switching devices SD1 are turned off.

In the period TS before the period fd1, all the switching devices SD1 and SD2 are turned on without scanning rows G1A–G4A. Thus, charge sharing may occur between capacitors Cs1 and Cs2 of the reflective cells 10 and transmission cells 20 to share charges therebetween.

The Fifth Embodiment

Figure 6C:
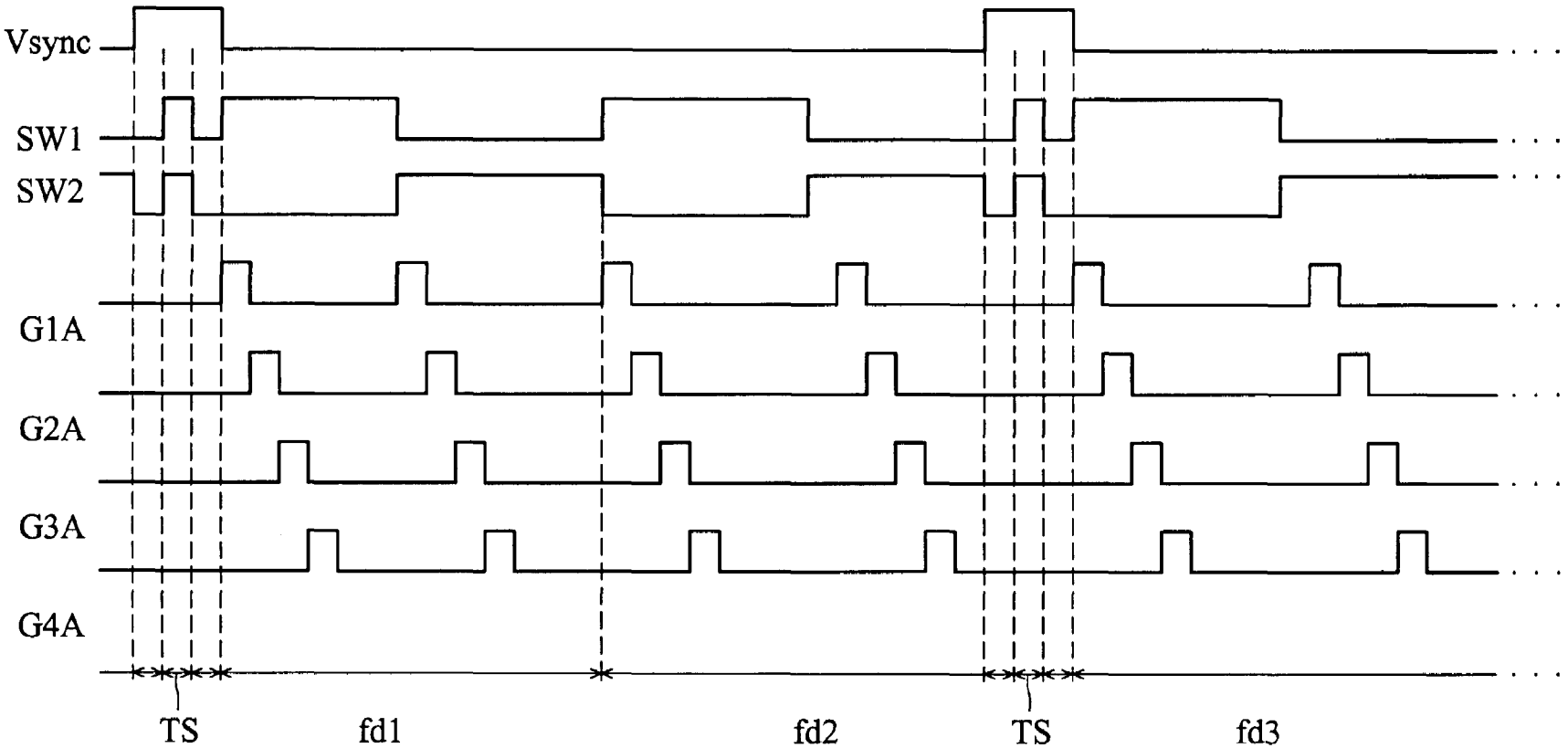
FIG. 6C shows a diagram of all waveforms in the fifth embodiment.

FIG. 6C shows a diagram of all waveforms in the fifth embodiment. The driving method of the embodiment is similarly to that in the fifth embodiment. In this case, a charge sharing period TS is added alternately before frame periods, wherein the period TS depends on an external signal Vsync. In each charge sharing period TS, all switching devices SD1 and SD2 are turned on without scanning rows G1A–G4A to share capacitors Cs1 and Cs2 of the reflective cells 10 and transmission cells 20. In FIG. 6, the charge sharing periods TS are added before the frame periods fd1 and fd3.

The Sixth Embodiment

Figure 7A:
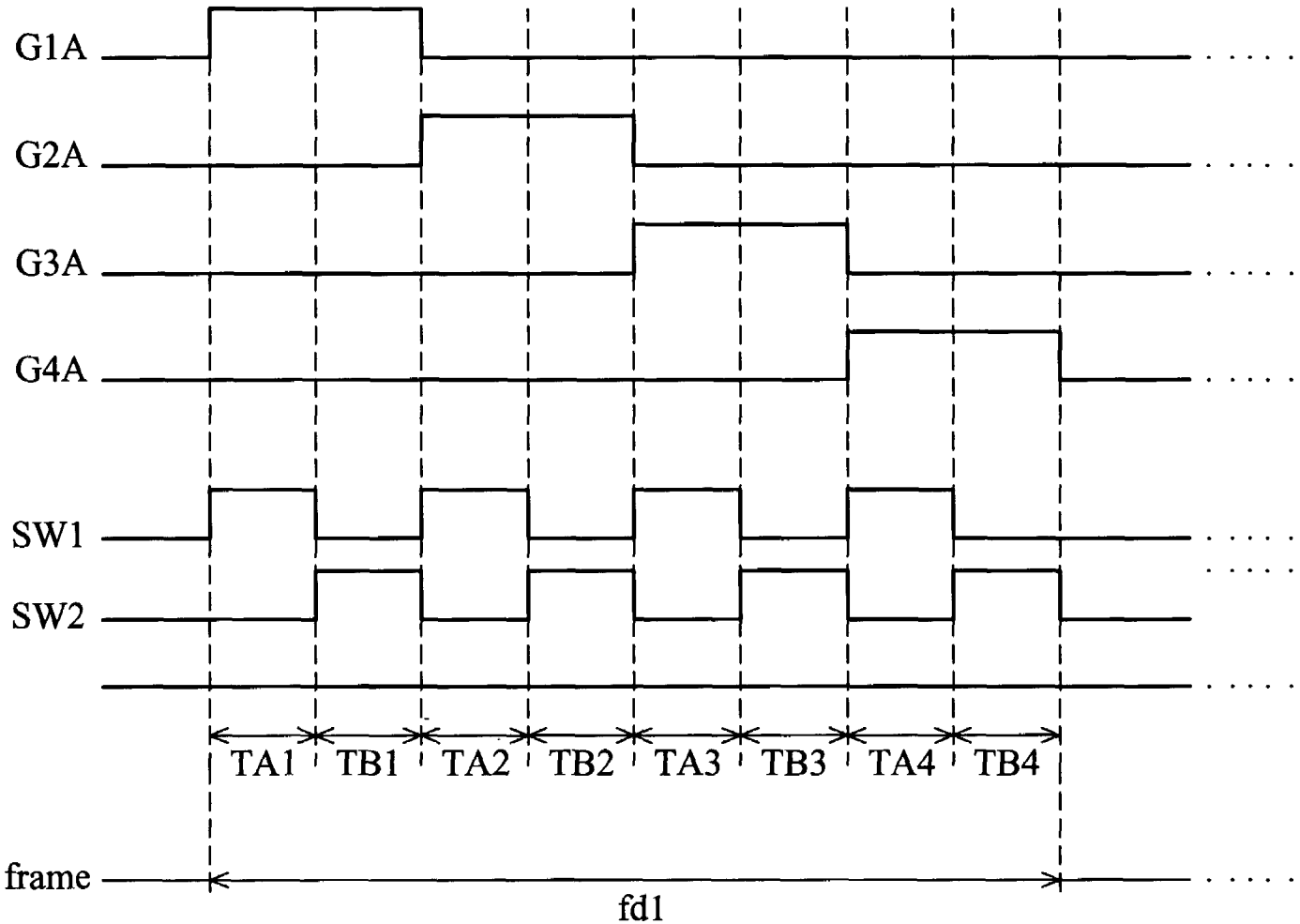
FIG. 7A shows a diagram of all waveforms in the sixth embodiment.

FIG. 7A shows a diagram of all waveforms in the sixth embodiment. As shown in FIG. 7A, in frame period fd1, all switching devices SD1 are turned on in periods TA1, TA2, TA3 and TA4, and all switching devices SD2 are turned on in periods TB1, TB2, TB3 and TB4. Rows are activated in sequence periods G1A–G2A-G3A-G4A. Row G1A is activated in periods TA1 and TB1 corresponding to switching device becoming active alternatively. Row G2A is activated in periods TA2 and TB2 corresponding to switching device becoming active alternatively. Row G3A is activated in periods TA3 and TB3 corresponding to switching device becoming active alternatively. Row G4A is activated in periods TA4 and TB4 corresponding to switching device becoming active alternatively.

In periods TA1, TA2, TA3 and TA4, the image signal driving circuit 100 feeds image signals (first driving voltages) to capacitors Clc1 and Cs1 of the reflective cells 10 via columns D1A–D4A when rows G1A–G4A are scanned respectively. In periods TB1, TB2, TB3 and TB4, the image signal driving circuit 100 feeds image signals (second driving voltages) to capacitors Clc2 and Cs2 of the transmission cells 20 via columns D2A–D2A when rows G1A–G4A are scanned respectively. That is to say, rows of the pixels are scanned in turn in one frame period, and the reflective cells and the transmission cells are turned on alternately when each pixel row is scanned.

The Seventh Embodiment

Figure 7B:
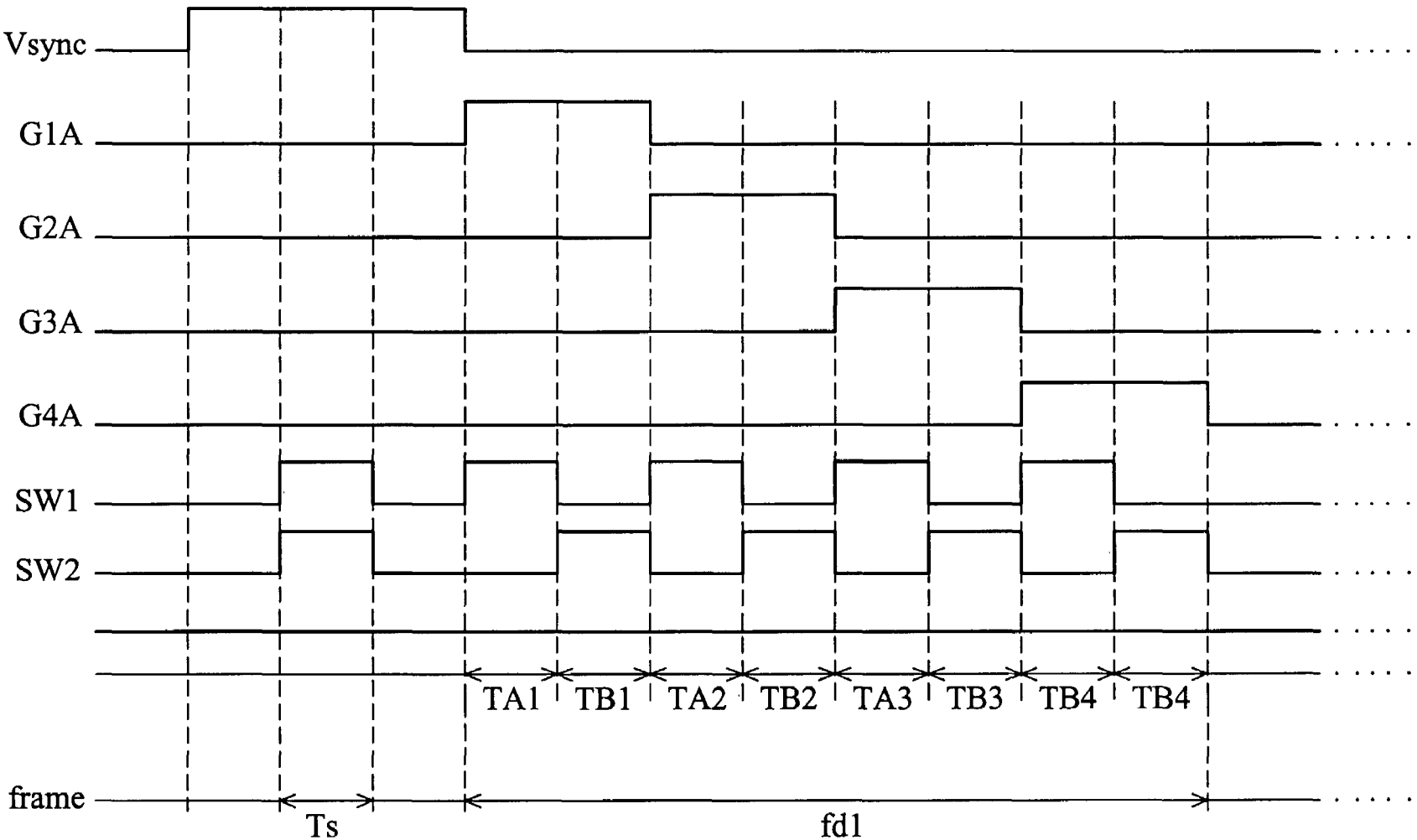
FIG. 7B shows a diagram of all waveforms in the seventh embodiment.

FIG. 7B shows a diagram of all waveforms in the seventh embodiment. As shown in FIG. 7B, in one frame period fd1, rows of the pixels are scanned in turn in one frame period, and the reflective cells and the transmission cells are turned on alternately when each pixel row is scanned. Furthermore, a charge sharing period TS occurs before frame period fd1 to share charges between the transmission cells and the reflective cells, wherein the period TS depends on an external signal Vsync. In charge sharing period TS, all switching devices SD1 and SD2 are turned on without scanning rows G1A–G4A.

The Eighth Embodiment

Figure 8:
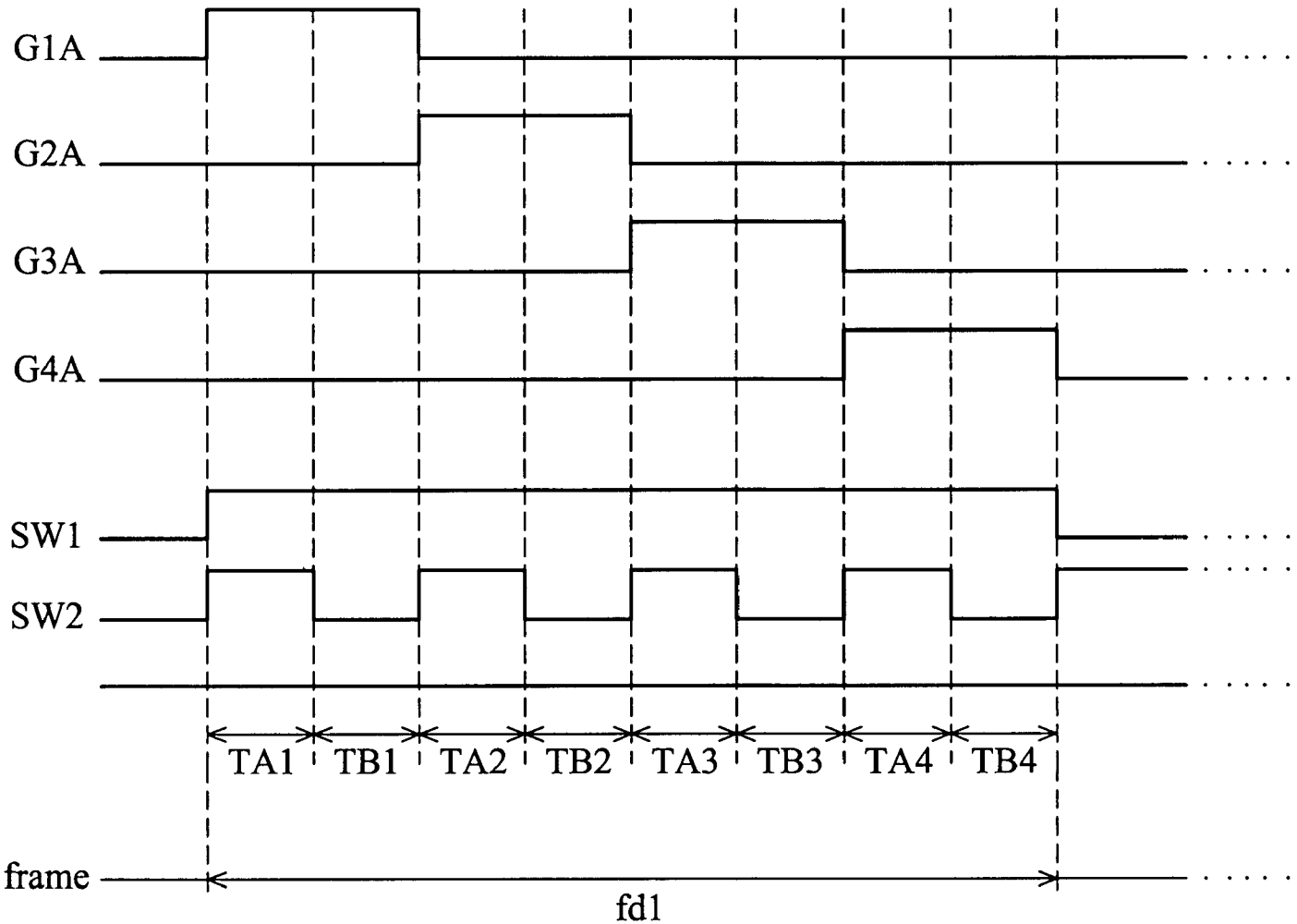
FIG. 8 shows a diagram of all waveforms in the eighth embodiment.

FIG. 8 shows a diagram of all waveforms in the eighth embodiment. As shown in FIG. 7A, in frame period fd1, all switching devices SD1 are turned on in whole period fd1 and all switching devices SD2 are turned on in periods TA1, TA2, TA3 and TA4. Rows are activated in sequence periods G1A–G2A–G3A–G4A.

In periods TA1, TA2, TA3 and TA4, the image signal driving circuit 100 feeds image signals (first driving voltages) to capacitors Clc1 and Cs1 of the reflective cells 10 via columns DlA–D4A and also feeds image signals (second driving voltages) to capacitors Clc2 and Cs2 of the transmission cells 20 via columns D2A–D2A when rows G1A–G4A are scanned respectively. In periods TB1, TB2, TB3 and TB4, the image signal driving circuit 100 only feeds image signals (first driving voltages) to capacitors Clc1 and Cs1 of the transmission cells 20 via columns D1A–D1A when rows G1A–G4A are scanned respectively.

Thus, the present invention can drive the transflective LCD effectively to achieve optimal reflectivity and transmittance without adjusting the cell gaps of the same phase difference according to the pixel structure and driving methods.

Although the present invention has been described in its preferred embodiments, it is not intended to limit the invention to the precise embodiments disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A method for driving a transflective LCD, wherein the transflective LCD has a plurality of pixels arranged in a matrix, each including a reflective cell and a transmission cell, the reflective cell having a first storage capacitor and a first active device, and the transmission cell having a second storage capacitor and a second active device, the method comprising the steps of:

providing first switching devices coupled between the reflective cells of the pixels and first driving voltages respectively;

providing second switching devices coupled between the transmission cells of the pixels and second driving voltages respectively;

turning on all the first switching devices and scanning the reflective cells in turn to apply the first driving voltages to the reflective cells in turn; and turning on all the second switching devices and scanning the transmission cells in turn to apply the second driving voltages to the transmission cells in turn;

wherein the first driving voltages are applied to the reflective cells in turn and the second driving voltages are applied to the transmission cells in turn in one frame period.

2. The method as claimed in claim 1, wherein the first switching devices are turned on when the second switching devices are turned off, and the first switching devices are turned off when the second switching device is turned on.

3. The method as claimed in claim 1, further comprising a step of turning on all the first switching devices and second switching devices without scanning any pixel before the frame period.

4. A method for driving a transflective LCD, wherein the transflective LCD has a plurality of pixels arranged in a matrix, each pixel including a reflective cell and a transmission cell, the reflective cell having a first storage capacitor and a first active device and the transmission cell having a second storage capacitor and a second active device, the method comprising the steps of:

providing first switching devices coupled between the reflective cells of the pixels and first driving voltages respectively;

providing second switching devices coupled between the transmission cells of the pixels and second driving voltages respectively;

scanning each row of the pixels in turn in one frame period; and turning on the first switching device and the second device at different times to apply the first driving voltage to the reflective cells and the second driving voltage to the transmission cells respectively, when each pixel row is scanned.

5. The method as claimed in claim 4, wherein reflective cells are turned on when the first switching devices and the second switching devices are turned on and off respectively.

6. The method as claimed in claim 4, wherein when transmission cells are turned on when the first switching devices and the second switching devices are turned off and on respectively.

7. The method as claimed in claim 6, further comprising a step of turning on all the first switching devices and second switching devices without scanning any pixel before the frame period.

8. A method for driving a transflective LCD, wherein the transflective LCD has a plurality of pixels arranged in a matrix, each pixel including a reflective cell and a transmission cell, the reflective cell having a first storage capacitor and a first active device and the transmission cell having a second storage capacitor and a second active device, the method comprising the steps of:

providing first switching devices coupled between the reflective cells of the pixels and first driving voltages respectively;

providing second switching devices coupled between the transmission cells of the pixels and second driving voltages respectively;

scanning each row of the pixels in turn in one frame period; and turning on the first switching device and the second switching devices simultaneously to apply the first driving voltages to the reflective cells and the second driving voltage to the transmission cells simultaneously when each pixel row is scanned, wherein the second switching devices are turned off earlier than the first switching devices.

9. A method for driving a transflective LCD, wherein the transflective LCD has a plurality of pixels arranged in a matrix, each pixel including a reflective cell and a transmission cell, the reflective cell having a first storage capacitor and a first active device and the transmission cell having a second storage capacitor and a second active device, the method comprising the steps of:

providing first switching devices coupled between the reflective cells of the pixels and first driving voltages respectively;

providing second switching devices coupled between the transmission cells of the pixels and second driving voltages respectively; and turning on the first switching devices to apply the first driving voltages to the reflective cells of the pixels and scanning each row of the pixels in turn simultaneously in one frame period.

10. A method for driving a transflective LCD, wherein the transflective LCD has a plurality of pixels arranged in a matrix, each pixel including a reflective cell and a transmission cell, the reflective cell having a first storage capacitor and a first active device and the transmission cell having a second storage capacitor and a second active device, the method comprising the steps of:

providing first switching devices coupled between the reflective cells of the pixels and first driving voltages respectively;

providing second switching devices coupled between the transmission cells of the pixels and second driving voltages respectively; and turning on the second switching devices to apply the second driving voltages to the transmission cells of the pixels and scanning each row of the pixels in turn simultaneously in one frame period.

* * * * *